United States Patent [19]

Amos

[11] 4,013,377

[45] Mar. 22, 1977

[54] INTERMEDIATE TRANSITION ANNULUS FOR A TWO SHAFT GAS TURBINE ENGINE

[75] Inventor: David J. Amos, Nether Providence Township, Pa.

[73] Assignee: Westinghouse Electric Corporation, Pittsburgh, Pa.

[22] Filed: Oct. 8, 1975

[21] Appl. No.: 620,608

[52] U.S. Cl. ..... 415/161; 60/39.16 R

[51] Int. Cl.[2] ..... F01D 17/14

[58] Field of Search ..... 415/160, 161; 60/39.16 R, 39.17 R

[56] References Cited

UNITED STATES PATENTS

| | | | |
|---|---|---|---|
| 1,865,503 | 7/1932 | Biggs | 415/160 |
| 2,065,974 | 12/1936 | Marquerre | 415/160 |
| 2,838,274 | 6/1958 | Fletcher et al. | 415/161 |
| 3,013,771 | 12/1961 | Henny | 415/160 |
| 3,151,841 | 10/1964 | Henny | 415/161 |
| 3,674,377 | 7/1972 | Trappmann | 415/160 |

*Primary Examiner*—Henry F. Raduazo
*Attorney, Agent, or Firm*—F. A. Winans

[57] ABSTRACT

A two shaft gas turbine engine is shown wherein the power turbine comprises a single stage which is closely coupled to the compressor turbine through an annular transition portion having radially diverging side walls forming an inner and outer shroud. The relatively high velocity of the working fluid is maintained through the transition portion by an array of non-rotating stationary struts. Each strut defines a camber line which at the entry of the strut is angled to receive the working fluid, having a swirl component therein, at a 0° angle of incidence. Further, each strut has a configuration which, in cooperation with the increasing angle of the camber line compensates for the divergence of the shrouds to maintain the flow of the working fluid at a generally undiminished velocity therethrough. An array of non-rotating variable vanes is disposed intermediate the downstream end of the struts to direct the working fluid into the power turbine at an optimum angular discharge depending upon the desired output of the power turbine shaft.

9 Claims, 3 Drawing Figures

INTERMEDIATE TRANSITION ANNULUS FOR A TWO SHAFT GAS TURBINE ENGINE

BACKGROUND OF THE INVENTION

1. Field of the Invention

The invention relates to a two shaft gas turbine engine and more particularly to such an engine wherein the discharge of the compressor turbine is closely coupled to a single stage power turbine through a relatively short transition annulus reducing the normal space between the power turbine and compressor turbine and providing a more axially compact unit.

2. Description of the Prior Art

Two shaft gas turbine engines are well known in the art. However, heretofore, the coupling between the high pressure compressor stage and the low pressure power turbine stage was accomplished either through a diffuser, to reduce losses, or in extremely close coupling, through stationary guide vanes. In the latter case, the blades of the compressor and power stages were closely related in both diameter and height.

In the power turbine of the present type having only one stage, the blade height and the outer diameter of each blade of the power turbine are substantially greater than the final stage of the compressor turbine so as to provide a sufficiently large discharge annular area to minimize the leaving losses (i.e., velocity) of the finally exhausted working fluid. Thus, ducting the working fluid from the small compressor turbine blade to the larger power turbine blade requires the inner and outer shroud defining the side walls of the duct to diverge. This configuration is generally typical of a diffusion section; however, in this instance the requirement for relatively close coupling did not permit sufficient axial length for a diffuser section followed by a nozzle portion to again accelerate the fluid into the power turbine.

SUMMARY OF THE INVENTION

The invention provides a relatively short transition annulus having diverging side walls formed by the inner and outer shroud to duct the working fluid from the relatively radially short compressor turbine blades to the radially extending power turbine blades of a single stage power turbine. An array of struts extend radially across the diverging walls and are disposed at an inlet angle with respect to the axis of the turbine so as to provide an angle of incidence with the incoming working fluid, which exhibits a swirl component therein, of zero degrees. The angle of the camber line of each strut gradually increases with respect to the axis along its axial extent so that, in conjunction with the generally ovate configuration of the struts, maintains the velocity of the working fluid through the transition portion relatively constant thereby eliminating the diffusion process. Variable non-rotating stationary vanes are disposed downstream of the struts to direct the fluid against the power turbine blades at an optimum angle regardless of the power demand on the power turbine shaft. The inner surfaces of the shrouds at the discharge end of the transition portion define concentric spherical segments having a common center on the axis of the turbine so that the adjacent facing surfaces of the ends of the variable vane, defining a mating concentric spherical curvature, provide a generally constant minimum gap therebetween regardless of the angular orientation of the vane. The spherical surfaces terminate generally tangential to the power turbine inlet to continue the smooth flow path. Thus, the turning axis of the variable vane in that it is upstream of the discharge end is angularly disposed with respect to a radial line at the discharge end so as to also intersect the common center of the spherical segments.

DESCRIPTION OF THE PREFERRED EMBODIMENT

The present invention, as previously explained, is particularly directed to an application wherein the last stage of a compressor turbine is closely coupled to a single stage power turbine of a two shaft gas turbine engine. Thus, the power turbine has a speed that can be varied without affecting the compressor turbine.

Figure 1:
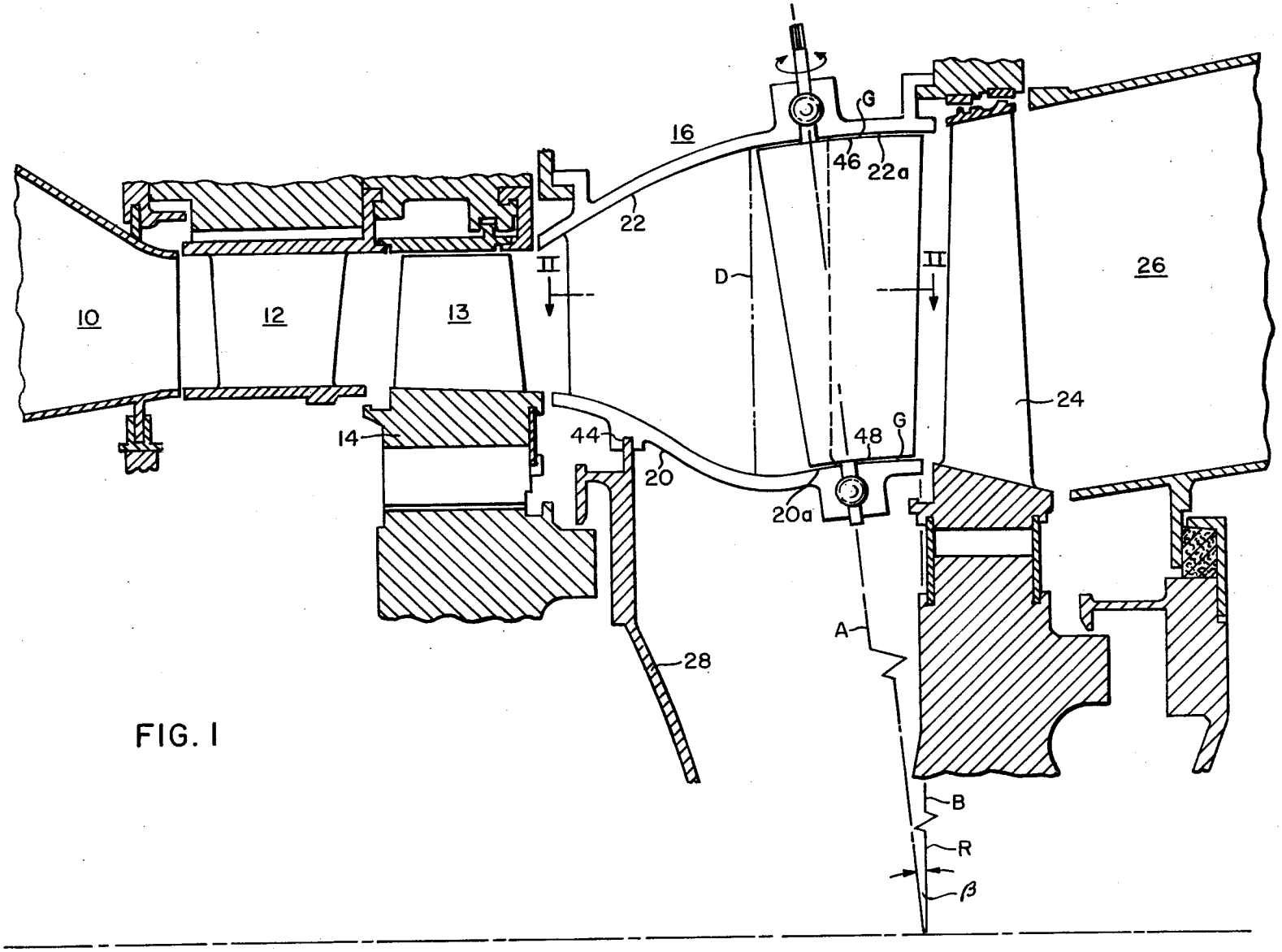
FIG. 1 is a cross-sectional longitudinal elevational view of a portion of a gas turbine engine showing the transition portion of the present invention.

Thus, referring to FIG. 1, a longitudinal cross-sectional portion of the gas flow path of such a gas turbine engine is shown. As therein seen, the working fluid, upon exiting the combustion chamber 10 flows into the compressor turbine comprising an array of stationary nozzle guide vanes 12 and the compressor turbine rotor blades 13 extending from the rotor disk 14 connected to the compressor shaft (not shown). Upon exiting the compressor turbine, the gas flows into an axially relatively short annular transition member 16 defined by side walls 20, 22 forming the inner and outer shroud respectively of the section and leading to the power turbine rotor disk and rotor blades 24 of a single stage power turbine having a shaft coaxial but separate from the shaft of the compressor turbine (also not shown). A sealing diaphragm 28 extends between the inner shroud 20 and the power turbine shaft to provide a positive seal between high pressure and low pressure sides of the turbine engine.

It will be noted that as this is a single stage power turbine, the annular area of the exit in the exhaust diffuser must be such that the velocity of the exiting gas is relatively small so that the leaving losses are minimal. This in turn requires the power turbine blades to be radially more extensive (in order to be generally coextensive with the enlarged exhaust area) than the compressor turbine blades. Thus, as is seen in FIG. 1, the side walls 20 and 22 gradually diverge from the entry area to an intermediate point D whereupon they extend generally parallel and at a distance generally coextensive with the annular entry into the power turbine to smoothly duct the working fluid from the relatively small annular area of the compressor turbine to the larger annular area of the power turbine.

Figure 2:
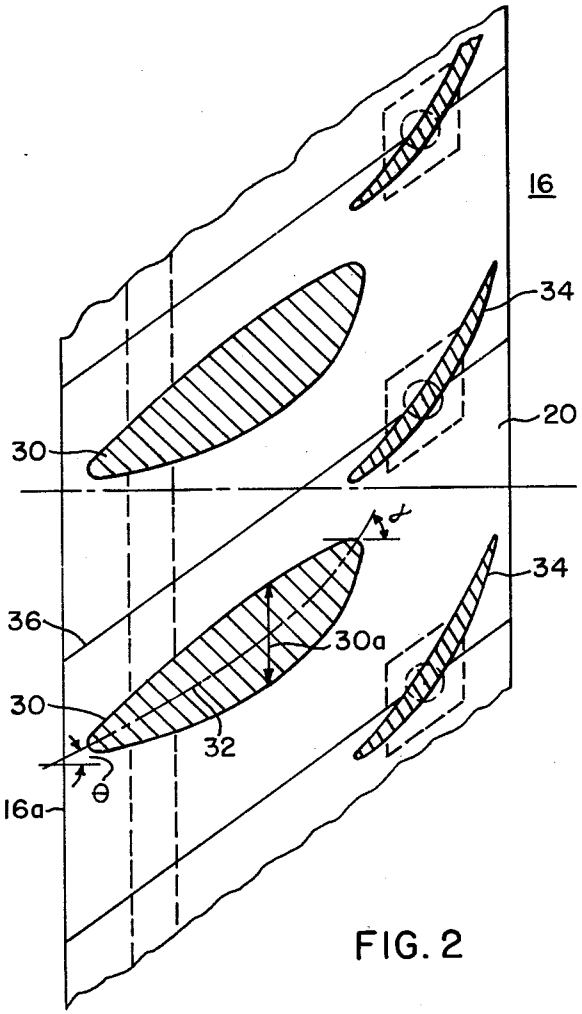
FIG. 2 is a view of a cross-section of the transition zone taken generally along line II—II of FIG. 1; and, FIG. 3 is a isometric exploded view of a single segment of the transition portion.

Heretofore, the transition portion 16 typically would have comprised a diffuser section to decrease the velocity and thus the losses accompanying ducting a high velocity working fluid and a nozzle section for again increasing the velocity of the fluid and giving it the proper direction just prior to it entering the power turbine blades 24. However, in the particular instance of the present invention, because of the desirability of the relatively close coupling between the compressor turbine and the power turbine it was felt desirable to maintain the working fluid at its generally high velocity while passing through the transition portion 16. Further, because of the inherent characteristics of the particular compressor turbine, the working fluid entering the transition portion exhibited a substantial swirl or circumferential (as opposed to axial) component. Thus, referring to FIG. 2, the transition portion 16 is seen to include a plurality (on the order of 60 to 70) struts 30 extending radially to connect the opposing side walls 20, 22. The struts extend axially from just adjacent the entry 16*a* into the transition member to beyond the point where the side walls cause diverging. The cross-sectional configuration of the struts 30 is generally constant throughout their radial extent and, as seen in FIG. 2, is generally ovate in that the opposite faces diverge from the leading edge to a point generally in alignment with the point of termination of divergence of the shrouds and then converge to the trailing or downstream edge.

It will be noted that the camber line 32 (i.e., the line joining the center of enscribed circles bounded by the opposite faces of the strut) is angled with respect to the axis of the shaft. The angle $\theta$ is such that it corresponds to the direction of flow of the working fluid to accommodate the swirl component so that at the inlet 16*a* to the transition portion 16 the angle of incidence between the strut and the fluid is generally zero.

It will also be noted that the angle $\alpha$ of the camber line 32 on the trailing edge of the strut 30 is greater than the entry angle $\theta$. The difference between these angles is referred to as the turning angle and is provided by a gradually increasing angular relationship from $\theta$ to $\alpha$ along the axial extent of the struts. This turning angle gradually restricts the effective fluid flow area between adjacent struts in the same manner that venetian blinds restrict the area between adjacent blinds as their turning angle is increased.

This gradual restriction of area between adjacent struts 30 due to their turning angle in conjunction with their gradually increasing width over the major portion of their axial extent compensates for the otherwise increase in annular area of the transition zone 16 provided by the diverging opposing walls 20, 22 to the end result that the area and thus the velocity of the working fluid through the transition member is maintained generally constant and on the order of the initial entry velocity. It should also be noted that the axial position at which the struts have their maximum width 30*a* generally corresponds to the position the opposing walls 20, 22 cease diverging (i.e., line D, FIG. 1) so that the annular area defined by the walls becomes constant thereafter. Thus, from this point to the downstream edge of the struts, the increasing annular area produced by the converging faces of the struts is compensated for by the turning angle to provide a restricted flow and maintain the constant velocity.

Figure 3:
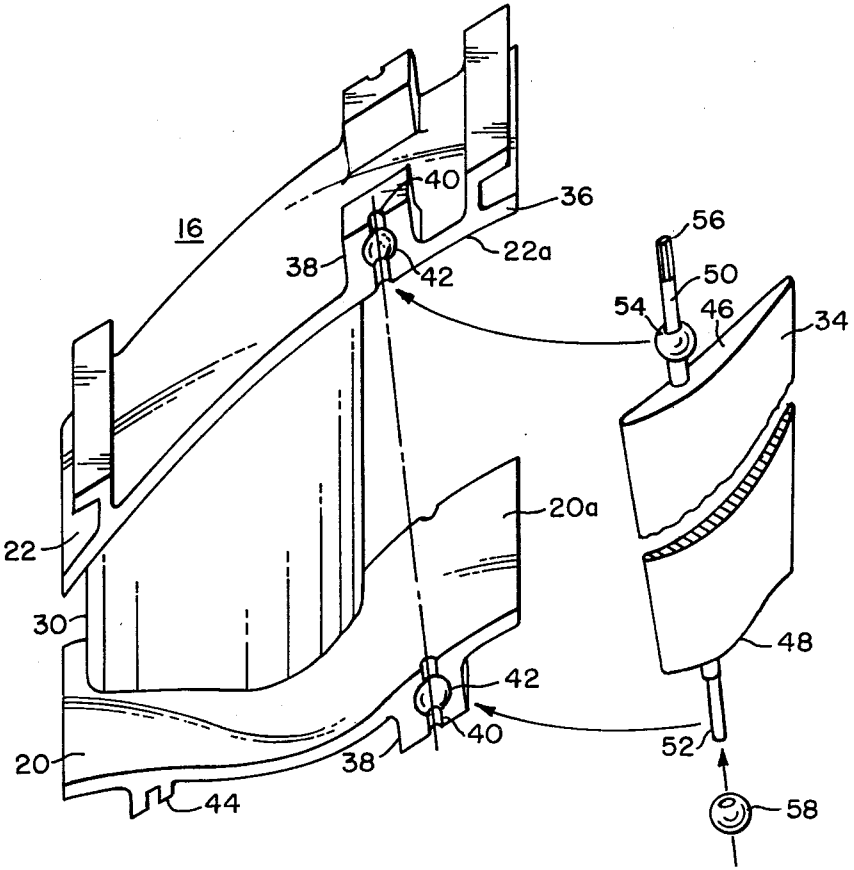

Also, for the reason that the power turbine is to be run at various speeds, an array of variable vanes 34 are disposed generally intermediate each pair of adjacent struts and immediately downstream thereof for directing the working fluid from the struts into the power turbine blade at an angle to optimize the efficiency of the power turbine. Referring now to FIG. 3, the disassembled transition member 16 and variable vane 34 is shown and generally comprises a single segment for each individual strut 30 with the opposing side walls 20, 22 and the strut 30 cast as an integral member. The parting line 36 between each adjacent segment is angled (as better seen in FIG. 2,) with respect to the axis of the shaft. The opposed shroud members 20 and 22 have short post portions 38 extending outwardly from their outer surfaces flush with the edge forming the parting line. Each post portion has a generally radially extending open sided bore 40 extending therethrough and a semi-shperical concavity 42 in each at an intermediate position. It is noted that the bores 40 are in alignment with each other along a line extending angularly from the axis of rotation of the shaft. Also, the undersurface of the inner wall of the shroud segment 20 defines a grooved rib 44 for rigid receipt of the outer peripheral lip of the sealing diaphragm 28.

The variable vane 34 includes a generally arcuately shaped air foil surface with the radially outer 46 and inner ends 48 thereof having generally radially extending pins 50 and 52. The radially outer pin 50 includes an integral spherical enlargement 54 at an intermediate position thereon that corresponds to the cavity 42 along the edge of the outer wall and terminates in a knurled end 56 for adaption through a mechanism (not shown) for varying the angular orientation of the vane from outside the turbine casing. The inner pin 52 includes a similar spherical member 58 telescopically received over it. Thus, the assembly of any two adjacent segments 16 define cavities 40, 42 for capturing the pins 50, 52 and the spherical members 56, 58 therebetween simplifying the bearing structure while at the same time permitting the lowest spherical bearing 58 to move radially on the pin 56 to accommodate differentials in growth of the inner shroud 20 caused by the variations of the temperature.

Also, to maintain a close fit between the ends 46, 48 of the variable vane and the adjacent surface of each opposing walls 20, 22 the axis of the angular movement of the vane is tilted with respect to a line R normal to the axis of the engine as at $\beta$ such that the projected axis A of the vane intersects the axis of the engine at a point substantially common to a radially extending line B passing through the segment closely adjacent the discharge end of the transition zone 16 and projected to the axis of the shaft. The radially outer 56 and inner 58 ends of the variable vane are then contoured to form concentric spherical surfaces having this point as a common center. The adjacent surfaces of the opposing side walls or that portion of each surface which the end of the vane would sweep when moved between extreme angular positions such as at 20*a* and 22*a* are likewise contoured as concentric spherical surfaces having the same common center so that no matter in which angular orientation the vane 34 is disposed, the tolerable gap G between the wall and the adjacent end of the vane remains constant. Also, in this regard, by having the discharge end of the transition zone 16 having opposed walls which are concentrically spherical on a radius which is substantially vertical (as viewed in FIG. 1) at the discharge end, the tangent to the spherical surfaces from this point are essentially parallel to the axis of the engine and thus leads smoothly into the axially downstream blade of the power turbine.

Thus, an annular transition member 16 or portion is shown that houses an annular array of struts 30 initially having an entry angle $\theta$ to accommodate the swirl component of the working fluid exiting from the compressor turbine 13 and also defining an ovate contour which in conjunction with the turning angle $\alpha$ compensates for the divergence of the opposing walls 20, 22 of the transition zone to maintain a generally constant velocity of the working fluid as it passes therethrough. Variable vanes 34 are also housed within the transition zone to optimize the efficiency of the working fluid delivered to the power turbine. The variable vanes have an axis A of angular positioning that permits the exiting working fluid to have a generally axially flow into the power turbine while maintaining a spherical interface between adjacent facing surfaces 46 and 48 of the vane with the opposing side walls 20, 22 to maintain a generally constant close tolerance therebetween regardless of the angular position of the vane in this transition portion.

I claim:

1. A two shaft gas turbine engine having a closely coupled fluid flow path between the compressor turbine and the power turbine through an annular duct means which comprises:

a plurality of individual arcuate segments comprising:

radially opposed axially extending wall members, the arcuate extent of the upstream and downstream end thereof in conjunction with the radial spacing therebetween defining inlet and outlet areas respectively of said segment;

said wall members diverging radially from the inlet area to a point generally intermediate the axial extent of each said member and continuing from said point to the outlet area in a generally concentric relationship whereby the outlet area is greater than the inlet area of each said segment;

at least one vane extending radially between and interconnecting said wall members, said vane extending axially from adjacent said inlet area to beyond said generally intermediate point and having an ovate longitudinal section defined by the opposite faces of said vane diverging axially from the leading edge of said vane to generally said intermediate point and thence converging to the trailing edge of said vane within the axial extent of said segment;

said ovate shaped vane further defining a camber line from the leading edge to the trailing edge forming a progressively increasing angle with respect to the axis of said engine to effectively progressively reduce the area between adjacent vanes; and, at least a second vane generally downstream of said one vane and extending radially to adjacent said opposed wall members and axially to adjacent said exit area whereby, the increase in annular area provided by said diverging wall members is for the most part compensated for by the increase in vane width along a predetermined axial length and then by the reduction of area between adjacent vanes provided by said angular orientation of said camber line to maintain the velocity of the fluid passing through said segment generally constant from said inlet area to at least said second vane.

2. Structure according to claim 1 wherein said second vane is pivotable about a generally radial axis for directing the working fluid into said power turbine at an optimum angle.

3. Structure according to claim 2 wherein a generally constant spacing is provided between each radial end of said second vane and the adjacent wall member over all angular settings of said second vane, said constant spacing being provided by the surfaces of said radially opposed ends of said second vane defining segments of concentric spheres and, at least that portion of the surface of the wall member swept by said adjacent vane end in its movement between extreme angular positions also defining segments of concentric spheres which are concentric with the spherical surfaces bounding said vane ends.

4. Structure according to claim 3 wherein the center of said concentric spherical surfaces is coaxial with the shafts of said engine.

5. Structure according to claim 4 wherein the axis of said second vane is disposed at an acute angle with respect to a line normal to the axis of said shafts, the intersection of the axis of said second vane and the axis of said shafts occurring at the center of said concentric spherical surfaces.

6. A two shaft gas turbine engine having a closely coupled fluid flow path between the compressor turbine and a power turbine through an annular duct means comprising a plurality of individual arcuate segments each of said segments including:

radially opposed wall members extending from adjacent the compressor turbine outlet to adjacent the power turbine inlet and defining a spatial separation between said wall members generally equivalent to the radial dimension of said outlet and said inlet at the upstream and downstream end respectively of said segment;

at least one stationary vane extending between and interconnecting said wall members generally adjacent said upstream end;

at least one variable vane mounted for pivotal movement about a generally radial axis in said downstream end and extending between said wall members so as to provide a minimal gap between said wall members and the adjacent radial end of said vane, said opposed wall members at least in the areas thereof swept by the adjacent radial end of said variable vane when moved an extreme position to another extreme position, defining segments of concentric spheres extending to the downstream terminal end of said wall member;

the opposed radial ends of said variable vanes also comprising segments of concentric spheres having a center point common to the concentric spheres of the opposed wall members surface, and wherein, said center point is common to the axis of the shafts of said engine and further wherein the axis of said variable vane intersects the axis of said shaft at said center point and;

wherein an axially extending projected tangent line from the downstream terminal end of said spherical segment of the wall members is substantially parallel to the axis of the shafts and the direction of flow of the motive gas through said power turbine.

7. Structure according to claim 6 wherein, the axis of said variable vane forms an acute angle with respect to a line normal to the axis of said shafts.

8. Structure according to claim 7 wherein the radius of curvature of the spherical segments of the respective wall members is equal to the annular radius of the wall member at the end of the arcuate segment adjacent the power turbine inlet.

9. In a two shafted gas turbine engine having a closely coupled fluid flow path between the compressor turbine and the power turbine through an annular transition portion, said transition portion defining axially extending radially diverging side walls providing increasing annular space in the direction of the flow of the working fluid, an annular array of stationary vanes extending radially across said side walls and defining an ovate cross-section having deiverging opposing walls from the leading edge to beyond the midpoint of said vanes, said opposing walls converging from this point to the trailing edge of said vane, said stationary vane further defining a camber line providing a progressively increasing angle between the camber line and the axis of said engine in the direction of flow of fluid through said portion, and an annular array of other vanes generally downstream from said stationary vanes and having a leading edge axially overlapping the trailing edge of said stationary vanes and wherein, the increase in annular space provided by the diverging side walls is, to a large degree, compensated for by an increase in vane thickness and the angular orientation of their camber line whereby the working fluid is generally maintained in its initial velocity when passing through said transition portion and said other vanes direct the working fluid into the power turbine at an optimum angle.

* * * * *